US010816163B1

(12) United States Patent
Hsu

(10) Patent No.: US 10,816,163 B1
(45) Date of Patent: Oct. 27, 2020

(54) CEILING LAMP EMITTING LIGHT UPWARD AND DOWNWARD

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/788,480

(22) Filed: Feb. 12, 2020

(51) Int. Cl.

| | |
|---|---|
| ***F21V 21/03*** | (2006.01) |
| ***F21V 3/06*** | (2018.01) |
| ***F21V 17/12*** | (2006.01) |
| ***F21V 7/00*** | (2006.01) |
| ***F21V 33/00*** | (2006.01) |
| ***F21V 13/04*** | (2006.01) |
| ***F21S 8/04*** | (2006.01) |

(52) U.S. Cl.
CPC ..... *F21V 7/0016* (2013.01); *F21S 8/04* (2013.01); *F21V 13/04* (2013.01); *F21V 33/0056* (2013.01)

(58) Field of Classification Search
CPC ..... F21Y 2115/10; F21Y 2103/33; F21S 8/04; F21S 8/02; F21S 8/043; F21V 21/03; F21V 21/02; F21V 21/044; F21V 2200/20; G02B 6/0088
See application file for complete search history.

(56) References Cited

U.S. PATENT DOCUMENTS

| | | | | |
|---|---|---|---|---|
| 9,057,505 | B2 * | 6/2015 | Liu | F21V 29/507 |
| 10,408,438 | B2 * | 9/2019 | Hsu | F21V 21/047 |
| 10,533,716 | B2 * | 1/2020 | Moon | G02B 6/0051 |
| 10,612,756 | B1 * | 4/2020 | Hsu | F21V 21/03 |
| 10,648,649 | B2 * | 5/2020 | Harris | F21V 5/008 |
| 2016/0091182 | A1 * | 3/2016 | Bardot | F21V 21/044 362/365 |
| 2019/0137071 | A1 * | 5/2019 | Li | F21V 3/10 |

* cited by examiner

*Primary Examiner* — Tracie Y Green
(74) *Attorney, Agent, or Firm* — Karin L. Williams; Mayer & Williams PC

(57) ABSTRACT

A ceiling lamp includes a mounting member, a lamp body, an upper lighting module, a lower lighting module, a sound device, and a control terminal. The lamp body includes a top plate, an inner shell, an outer shell, and a light output module. The light output module includes an upper diffusion board, a reflective member, a light guide board, and a lower diffusion board. Thus, the upper lighting module emits light upward, and the lower lighting module emits light downward such that the ceiling lamp provides upward and downward lighting effect.

10 Claims, 5 Drawing Sheets

CEILING LAMP EMITTING LIGHT UPWARD AND DOWNWARD

BACKGROUND OF THE INVENTION

1. Field of the Invention

The present invention relates to an illuminating apparatus and, more particularly, to a ceiling lamp (or ceiling fitting or ceiling lighting).

2. Description of the Related Art

A ceiling lamp or ceiling fitting is mounted on the ceiling to provide an illuminating function. A conventional ceiling lamp comprises a base, a lamp holder, a housing, and a light source. However, the conventional ceiling lamp only emits light downward and cannot emit light upward, such that the lighting effect is limited and cannot satisfy the requirement of different users. In addition, the conventional ceiling lamp has a low light output efficiency and has a high cost.

BRIEF SUMMARY OF THE INVENTION

The primary objective of the present invention is to provide a ceiling lamp that emits light upward and downward.

In accordance with the present invention, there is provided a ceiling lamp comprising a mounting member, a lamp body, an upper lighting module, a lower lighting module, and a sound device. The upper lighting module, the lower lighting module, and the sound device are mounted in the lamp body. The lamp body includes a top plate, an inner shell, an outer shell, and a light output module. The top plate is secured to a bottom of the mounting member. The inner shell is mounted on a bottom of the top plate. The outer shell is mounted on a bottom of the inner shell. The top plate has a middle provided with a mounting recess. A plurality of elastic plates are mounted on the top plate. Each of the elastic plates has a middle provided with a bent limit portion extending into the mounting recess of the top plate. The bottom of the mounting member is provided with a plurality of projections pressing the elastic plates respectively. The projections of the mounting member are inserted into the mounting recess of the top plate and arranged between the elastic plates. The mounting member is rotated relative to the top plate, and the projections of the mounting member are moved to a position where each of the projections of the mounting member is located under the limit portion of one of the elastic plates. Each of the projections of the mounting member is restricted by the limit portion of one of the elastic plates. The top plate is provided with a lamp groove located outside of the mounting recess. The lamp groove of the top plate has an annular shape. The upper lighting module is mounted in the lamp groove of the top plate. The light output module includes an upper diffusion board, a reflective member, a light guide board, and a lower diffusion board. The upper diffusion board is located above the lamp groove of the top plate. The reflective member is located below the upper diffusion board. The light guide board is located below the reflective member. The lower diffusion board is located below the light guide board. The top plate, the inner shell, and the outer shell form a receiving space. The reflective member, the light guide board, and the lower diffusion board are mounted in the receiving space. The lower lighting module is mounted in the inner shell, and is located outside of the light guide board. The upper lighting module emits light upward, and the lower lighting module emits light downward respectively or simultaneously.

According to the primary advantage of the present invention, the upper lighting module emits light upward, and the lower lighting module emits light downward such that the ceiling lamp provides upward and downward lighting effect.

According to another advantage of the present invention, the upper lighting module and the lower lighting module emit light upward and downward independently or simultaneously according to the user's requirement, so as to provide a better indoor illuminating effect.

According to a further advantage of the present invention, the ceiling lamp provides a Bluetooth speaker function by provision of the sound device.

According to a further advantage of the present invention, the ceiling lamp is assembled simply and conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
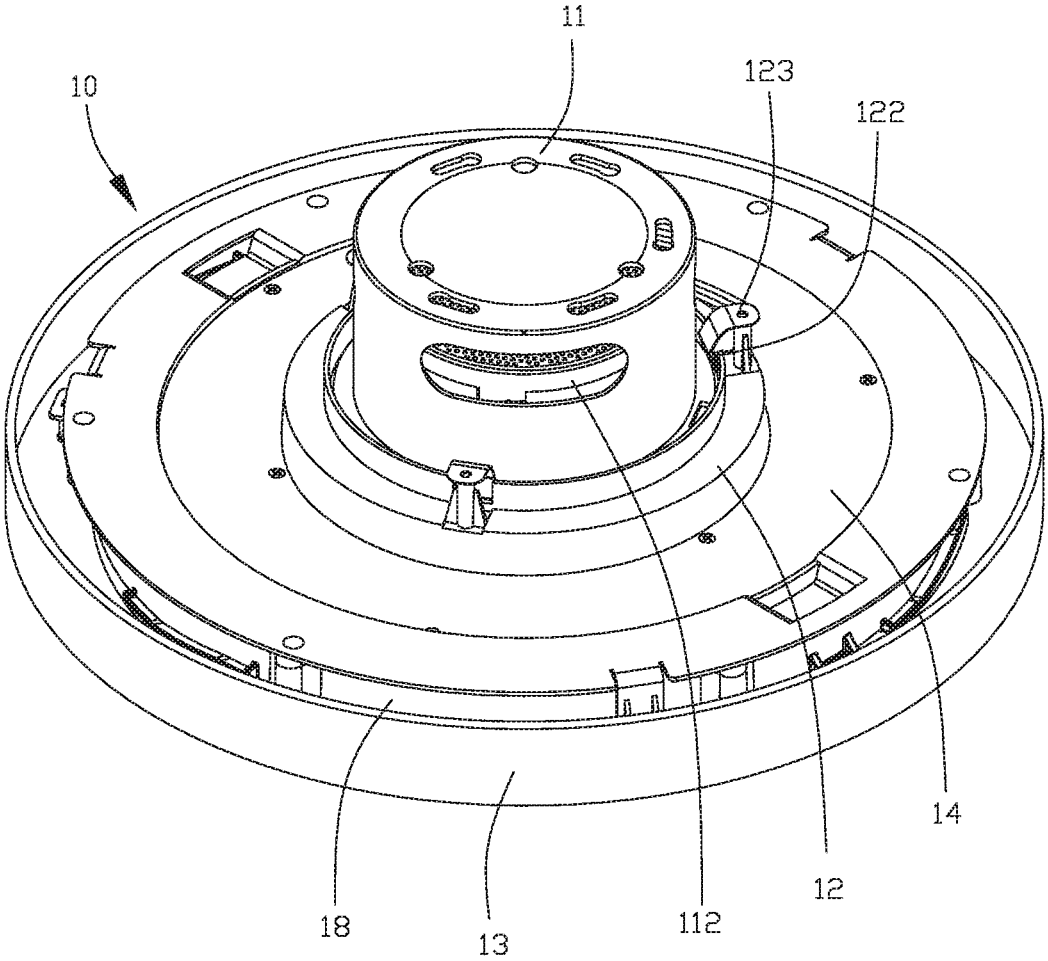
FIG. 1 is a perspective view of a ceiling lamp in accordance with the preferred embodiment of the present invention.
Figure 2:
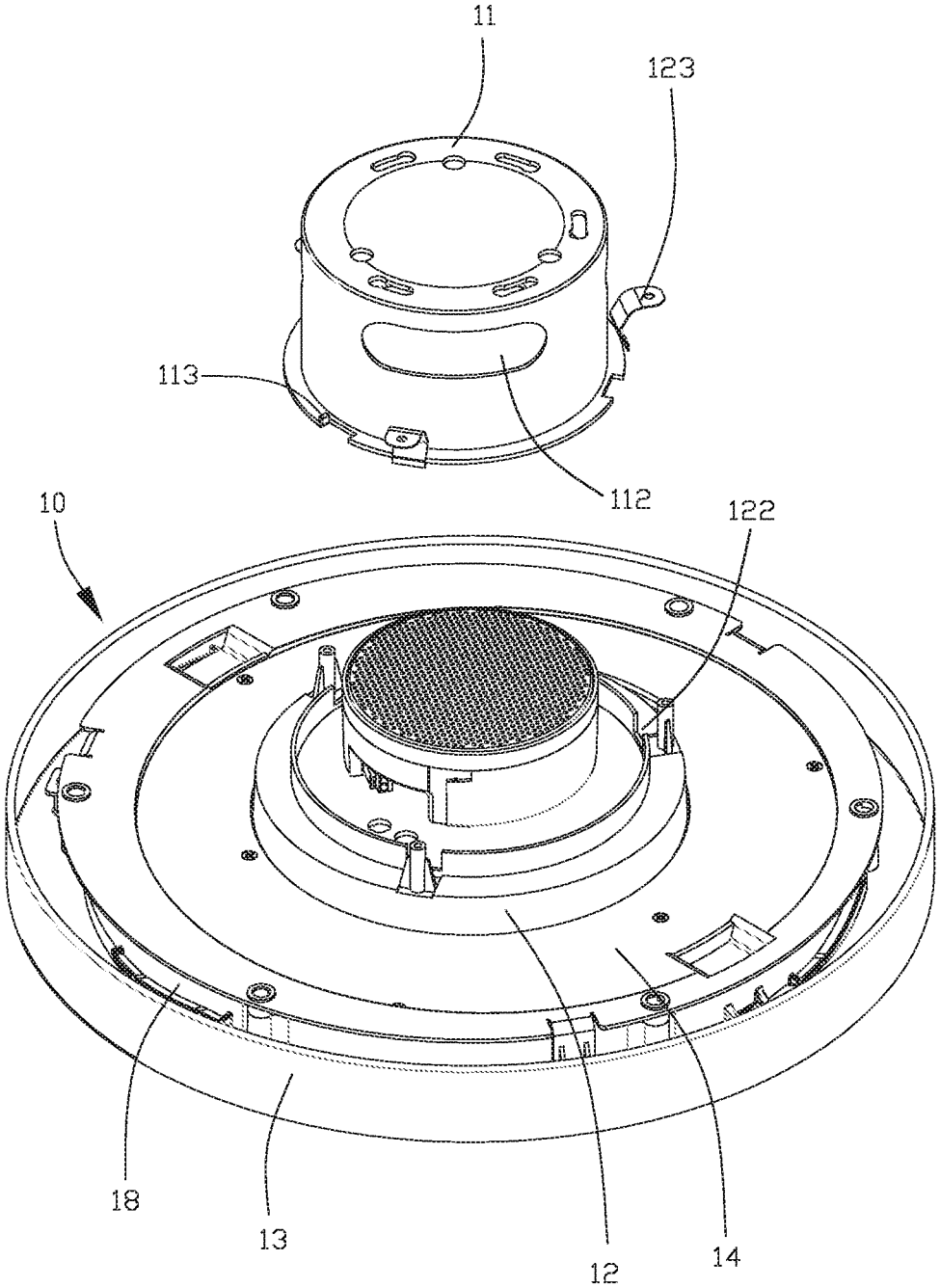
FIG. 2 is a partial exploded perspective view of the ceiling lamp in accordance with the preferred embodiment of the present invention.
Figure 3:
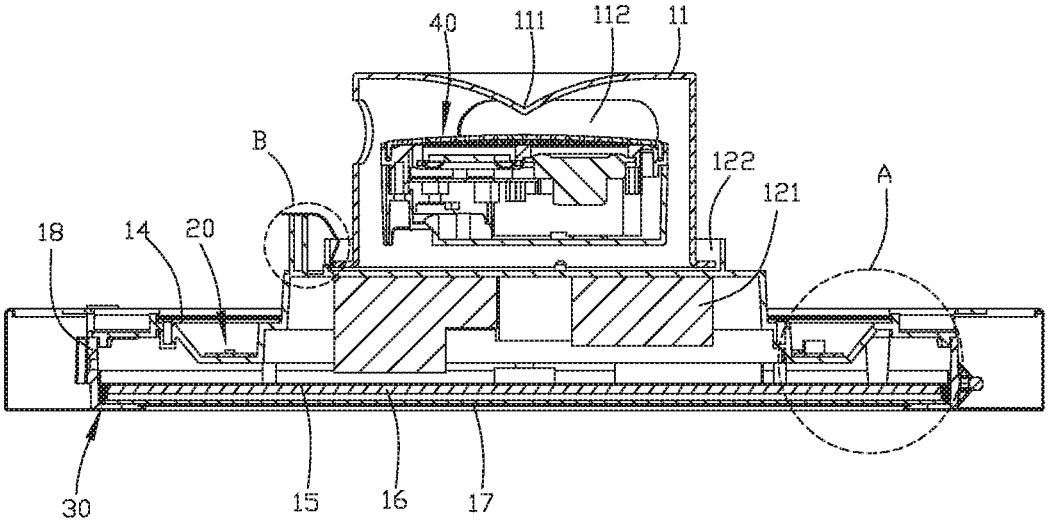
FIG. 3 is a cross-sectional view of the ceiling lamp as shown in FIG. 1.
Figure 4:
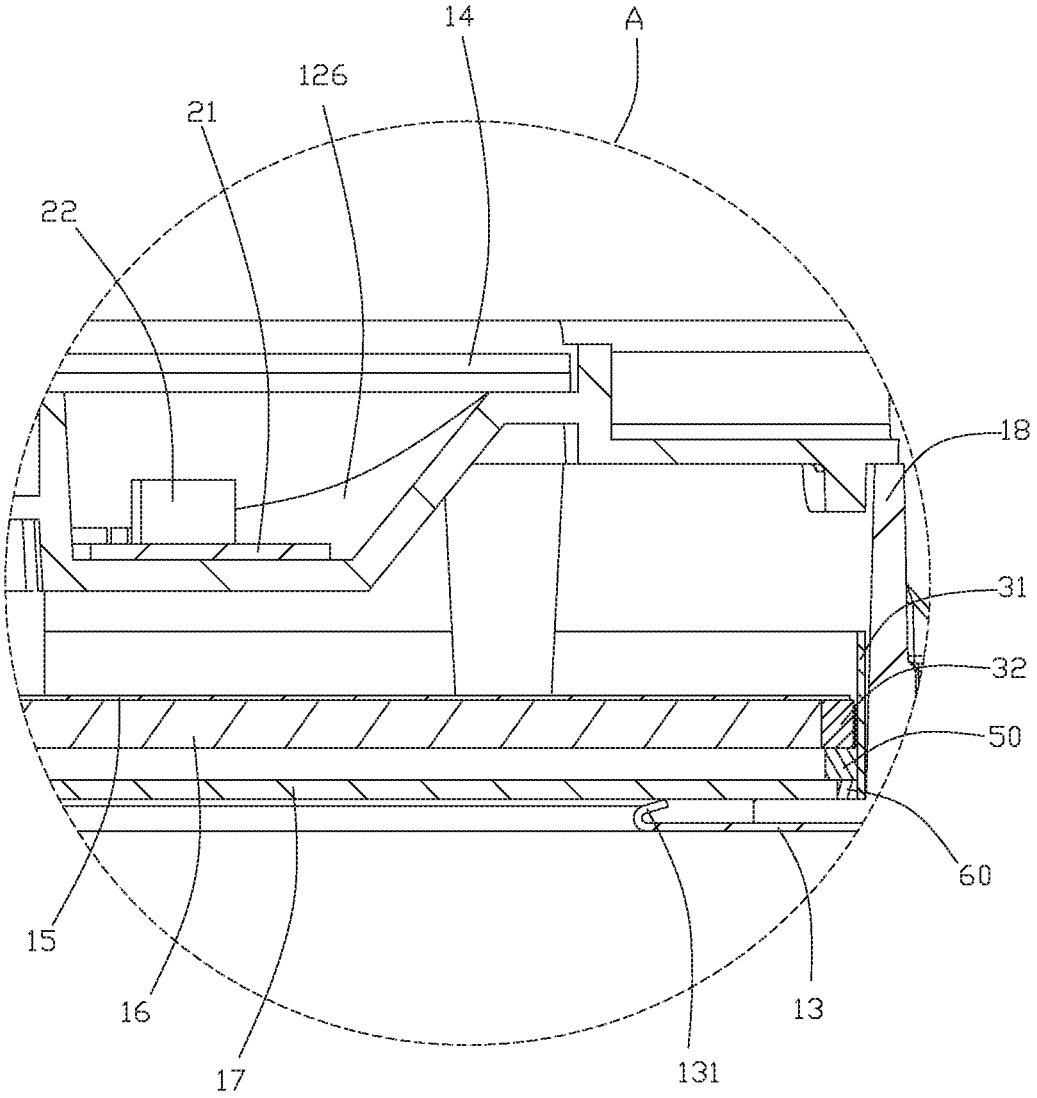
FIG. 4 is a locally enlarged view of the ceiling lamp taken along a circle "A" as shown in FIG. 3.
Figure 5:
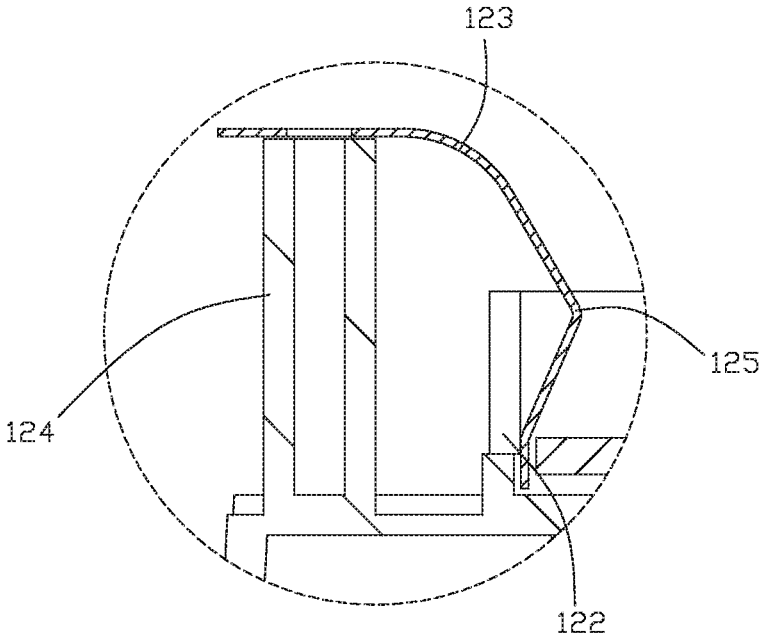
FIG. 5 is a locally enlarged view of the ceiling lamp taken along a circle "B" as shown in FIG. 3.

Referring to FIGS. 1-5, a ceiling lamp in accordance with the preferred embodiment of the present invention comprises a mounting member 11, a lamp body 10, an upper lighting module 20, a lower lighting module 30, and a sound device 40. The upper lighting module 20, the lower lighting module 30, and the sound device 40 are mounted in the lamp body 10.

The lamp body 10 includes a top plate 12, an inner shell 18, an outer shell 13, and a light output module. The top plate 12 is secured to (or locked onto) a bottom of the mounting member 11. The inner shell 18 is mounted on a bottom of the top plate 12. The outer shell 13 is mounted on a bottom of the inner shell 18. The top plate 12 has a middle provided with a mounting recess 122. A plurality of elastic plates 123 are mounted on the top plate 12. Each of the elastic plates 123 has a middle provided with a bent limit portion 125 extending into the mounting recess 122 of the top plate 12. The bottom of the mounting member 11 is provided with a plurality of projections 113 pressing the elastic plates 123 respectively. The projections 113 of the mounting member 11 extend radially and outwardly.

In assembly, the projections 113 of the mounting member 11 are inserted into the mounting recess 122 of the top plate 12 and arranged between the elastic plates 123. Then, the mounting member 11 is rotated relative to the top plate 12, and the projections 113 of the mounting member 11 are moved to a position where each of the projections 113 of the mounting member 11 is located under the limit portion 125 of one of the elastic plates 123, such that each of the projections 113 of the mounting member 11 is restricted by the limit portion 125 of one of the elastic plates 123.

The top plate 12 is provided with a lamp groove 126 located outside of the mounting recess 122. The lamp groove 126 of the top plate 12 has an annular shape. The upper lighting module 20 is mounted in the lamp groove 126 of the top plate 12.

The light output module includes an upper diffusion board 14, a reflective member 15, a light guide board 16, and a lower diffusion board 17. The upper diffusion board 14 is arranged on an upper face of the top plate 12, and is located above the lamp groove 126 of the top plate 12. The reflective member 15 is located below the upper diffusion board 14. The reflective member 15 is preferably a piece of paper. The light guide board 16 is located below the reflective member 15. The lower diffusion board 17 is located below the light guide board 16. The top plate 12, the inner shell 18, and the outer shell 13 form a receiving space. The reflective member 15, the light guide board 16, and the lower diffusion board 17 are mounted in the receiving space.

The lower lighting module 30 is mounted in the inner shell 18, and is located outside of the light guide board 16. In practice, the upper lighting module 20 emits light upward, and the lower lighting module 30 emits light downward respectively or simultaneously.

In the preferred embodiment of the present invention, the lower lighting module 30 includes a lower lamp board 31 having an annular arrangement, and at least one light emitting member (or lighting ball) 32 mounted in the lower lamp board 31. The lower lamp board 31 is a light output board that extends vertically. The lower diffusion board 17 diffuses the light rays emitted from the at least one light emitting member 32 of the lower lighting module 30.

In the preferred embodiment of the present invention, the lamp body 10 further includes a first washer 50 located under the at least one light emitting member 32 of the lower lighting module 30. The first washer 50 separates the light guide board 16 from the lower diffusion board 17. The reflective member 15 is located above the at least one light emitting member 32 of the lower lighting module 30. The light guide board 16 is located in the at least one light emitting member 32 of the lower lighting module 30.

In the preferred embodiment of the present invention, the lamp body 10 further includes a second washer 60 located outside of the lower diffusion board 17. The lower diffusion board 17 is limited by the second washer 60 and the outer shell 13.

In the preferred embodiment of the present invention, the mounting member 11 has a top having a concave arrangement. The top of the mounting member 11 is concave radially and inward and has a center formed with a pointed portion 111. The pointed portion 111 of the mounting member 11 is directed toward the sound device 40 and has a function of guiding and diffusing the sound. The sound device 40 has a sound output portion corresponding to the pointed portion 111 of the mounting member 11.

In the preferred embodiment of the present invention, the mounting member 11 has a peripheral wall provided with a plurality of sound output slots 112. Thus, sound from the sound device 40 is guided and diffused evenly by the pointed portion 111 of the mounting member 11, and is emitted outward through the sound output slots 112 of the mounting member 11.

In the preferred embodiment of the present invention, the lamp groove 126 of the top plate 12 has an inclined wall to increase the light output angle, and the upper diffusion board 14 covers the lamp groove 126 of the top plate 12.

In the preferred embodiment of the present invention, the outer shell 13 has a bottom formed with a bent support portion 131 extending upward. The support portion 131 of the outer shell 13 has waterproof, dustproof, and support functions. The inner shell 18 has a bottom formed with a bottom plate extending inward. The support portion 131 of the outer shell 13 has a top horizontally flush with an upper face of the bottom plate of the inner shell 18.

In the preferred embodiment of the present invention, the lower diffusion board 17 is retained by the first washer 50 and the support portion 131 of the outer shell 13, such that the lower diffusion board 17 is mounted steadily and solidly.

In the preferred embodiment of the present invention, the upper lighting module 20 includes an upper lamp board 21 mounted on a bottom of the lamp groove 126, and a plurality of light emitting members (or lighting balls) 22 mounted on an upper face of the upper lamp board 21. The upper lamp board 21 is a light output board. The upper diffusion board 14 diffuses the light rays emitted from the light emitting members 22 of the upper lighting module 20.

In the preferred embodiment of the present invention, the ceiling lamp further comprises a control terminal mounted in the lamp body 10 and electrically connected with the upper lighting module 20, the lower lighting module 30, and the sound device 40, for controlling operation of the upper lighting module 20, the lower lighting module 30, and the sound device 40. The control terminal is preferably a smart terminal device or a remote controller. Thus, the upper lighting module 20 and the lower lighting module 30 emit light upward and downward independently or simultaneously by operation of the control terminal.

In the preferred embodiment of the present invention, the middle of the top plate 12 is provided with a protruding platform 121, and the mounting recess 122 of the top plate 12 is formed in the protruding platform 121. The protruding platform 121 of the top plate 12 is provided with a plurality of mounting pillars 124 located outside of the mounting recess 122. The mounting recess 122 of the top plate 12 has a plurality of openings corresponding to the mounting pillars 124 respectively. The elastic plates 123 are mounted on the mounting pillars 124 and partially extend into the mounting recess 122 of the top plate 12. Each of the elastic plates 123 has a first end secured to one of the mounting pillars 124 by a screw, and a second end received in the mounting recess 122 of the top plate 12.

In the preferred embodiment of the present invention, the mounting recess 122 of the top plate 12 is provided with a plurality of positioning blocks locked onto the projections 113 of the mounting member 11. Thus, the projections 113 of the mounting member 11 are stopped by the positioning blocks of the top plate 12, such that the projections 113 of the mounting member 11 are located under the elastic plates 123.

In the preferred embodiment of the present invention, the lamp groove 126 of the top plate 12 is arranged outside of the protruding platform 121.

Accordingly, the upper lighting module 20 emits light upward, and the lower lighting module 30 emits light downward such that the ceiling lamp provides upward and downward lighting effect. In addition, the upper lighting module 20 and the lower lighting module 30 emit light upward and downward independently or simultaneously according to the user's requirement, so as to provide a better indoor illuminating effect. Further, the ceiling lamp provides a Bluetooth speaker function by provision of the sound device 40. Further, the ceiling lamp is assembled simply and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling lamp comprising:

a mounting member, a lamp body, an upper lighting module, a lower lighting module, and a sound device; wherein:

the upper lighting module, the lower lighting module, and the sound device are mounted in the lamp body;

the lamp body includes a top plate, an inner shell, an outer shell, and a light output module;

the top plate is secured to a bottom of the mounting member;

the inner shell is mounted on a bottom of the top plate;

the outer shell is mounted on a bottom of the inner shell;

the top plate has a middle provided with a mounting recess;

a plurality of elastic plates are mounted on the top plate;

each of the elastic plates has a middle provided with a bent limit portion extending into the mounting recess of the top plate;

the bottom of the mounting member is provided with a plurality of projections pressing the elastic plates respectively;

the projections of the mounting member are inserted into the mounting recess of the top plate and arranged between the elastic plates;

the mounting member is rotated relative to the top plate, and the projections of the mounting member are moved to a position where each of the projections of the mounting member is located under the limit portion of one of the elastic plates;

each of the projections of the mounting member is restricted by the limit portion of one of the elastic plates;

the top plate is provided with a lamp groove located outside of the mounting recess;

the lamp groove of the top plate has an annular shape;

the upper lighting module is mounted in the lamp groove of the top plate;

the light output module includes an upper diffusion board, a reflective member, a light guide board, and a lower diffusion board;

the upper diffusion board is located above the lamp groove of the top plate;

the reflective member is located below the upper diffusion board;

the light guide board is located below the reflective member;

the lower diffusion board is located below the light guide board;

the top plate, the inner shell, and the outer shell form a receiving space;

the reflective member, the light guide board, and the lower diffusion board are mounted in the receiving space;

the lower lighting module is mounted in the inner shell, and is located outside of the light guide board; and the upper lighting module emits light upward, and the lower lighting module emits light downward respectively or simultaneously.

2. The ceiling lamp of claim 1, wherein:

the lower lighting module includes a lower lamp board having an annular arrangement, and at least one light emitting member mounted in the lower lamp board; and the lower lamp board is a light output board that extends vertically.

3. The ceiling lamp of claim 2, wherein:

the lamp body further includes a first washer located under the at least one light emitting member of the lower lighting module;

the first washer separates the light guide board from the lower diffusion board;

the reflective member is located above the at least one light emitting member of the lower lighting module; and the light guide board is located in the at least one light emitting member of the lower lighting module.

4. The ceiling lamp of claim 3, wherein the lamp body further includes a second washer located outside of the lower diffusion board, and the lower diffusion board is limited by the second washer and the outer shell.

5. The ceiling lamp of claim 1, wherein:

the mounting member has a top having a concave arrangement;

the top of the mounting member is concave radially and inward and has a center formed with a pointed portion; and the pointed portion of the mounting member is directed toward the sound device.

6. The ceiling lamp of claim 5, wherein the mounting member has a peripheral wall provided with a plurality of sound output slots, and sound from the sound device is guided and diffused evenly by the pointed portion of the mounting member, and is emitted outward through the sound output slots of the mounting member.

7. The ceiling lamp of claim 1, wherein the lamp groove of the top plate has an inclined wall, and the upper diffusion board covers the lamp groove of the top plate.

8. The ceiling lamp of claim 1, wherein:

the outer shell has a bottom formed with a bent support portion extending upward;

the inner shell has a bottom formed with a bottom plate extending inward; and the support portion of the outer shell has a top horizontally flush with an upper face of the bottom plate of the inner shell.

9. The ceiling lamp of claim 1, wherein:

the upper lighting module includes an upper lamp board mounted on a bottom of the lamp groove, and a plurality of light emitting members mounted on an upper face of the upper lamp board; and the upper lamp board is a light output board.

10. The ceiling lamp of claim 1, further comprising:

a control terminal mounted in the lamp body and electrically connected with the upper lighting module, the lower lighting module, and the sound device, for controlling operation of the upper lighting module, the lower lighting module, and the sound device.

* * * * *